US005438948A

United States Patent [19]

Moody

[11] Patent Number: 5,438,948

[45] Date of Patent: Aug. 8, 1995

[54] ELASTOMERIC LAUNCH SYSTEM FOR SUBMARINES

[75] Inventor: Paul E. Moody, Barrington, R.I.

[73] Assignee: The United States of America as represented by the Secretary of the Navy, Washington, D.C.

[21] Appl. No.: 294,456

[22] Filed: Aug. 22, 1994

[51] Int. Cl.[6] ..... B63G 8/28

[52] U.S. Cl. ..... 114/319; 114/238; 689/1.810

[58] Field of Search ..... 114/316–318, 114/319, 238; 124/70, 69, 71, 73; 89/1.810, 1.809; 42/1.14

[56] References Cited

U.S. PATENT DOCUMENTS

| | | | |
|---|---|---|---|
| 2,848,970 | 8/1958 | Gunning | 114/319 |
| 4,523,538 | 6/1985 | Hollmann et al. | 124/70 |
| 4,848,210 | 7/1989 | Bissonnette | 114/319 |
| 5,085,122 | 2/1992 | Berlam et al. | 114/319 |
| 5,200,572 | 4/1993 | Bissonnette et al. | 89/1.81 |
| 5,231,241 | 7/1993 | Bissonnette | 114/238 |

*Primary Examiner*—Edwin L. Swinehart
*Attorney, Agent, or Firm*—Michael J. McGowan; Privthvi C. Lall; James M. Kasischke

[57] ABSTRACT

An apparatus for providing a pressurized liquid to a launch tube for launching projectiles into a liquid medium. The device comprises an elastomeric bladder disposed inside a cylindrical bypass tube. The forward end of the bypass tube is open to the liquid medium, and the aft end of the tube is hydraulically connected to the launch tube. The elastomeric bladder is externally of generally cylindrical shape and has an open aft end, a closed forward end and a side wall of varying thickness. The open end of the bladder is hydraulically connected to valves which act to control charging of the bladder and firing of the bladder. The bladder expands to contact the wall of the bypass tube when the bladder is filled with pressurized seawater. Ultimately the whole bladder will act to seal the bypass tube by contact with the bypass tube wall to prevent the external liquid medium from communicating with the launch tube through the bypass tube. Upon vehicle launch pressurized liquid is provided from the elastomeric bladder to the launch tube. The bladder returns to its original shape after discharge breaking contact with the bypass tube wall, and liquid is allowed to flow through the bypass tube into the launch tube to prevent cavitation from occurring at the launch tube breech.

13 Claims, 3 Drawing Sheets

ELASTOMERIC LAUNCH SYSTEM FOR SUBMARINES

STATEMENT OF GOVERNMENT INTEREST

The invention described herein may be manufactured and used by or for the Government of the United States of America for governmental purposes without the payment of any royalties therefor.

CROSS REFERENCE TO RELATED PATENT APPLICATIONS

This patent application is co-pending with a related application having common ownership on the date of invention and filed on the same date as subject patent application entitled Flow-Through Elastomeric Launch System for Submarines by Ronald E. Waclawik and Scott D. Boyd further identified as Navy Case No. 74448.

BACKGROUND OF THE INVENTION (1) Field of the Invention

The invention relates to an elastomeric launch system, and more specifically to a submarine low-noise projectile launching system.

(2) Description of the Prior Art

Existing submarine weapon launch systems are mechanisms which eject a torpedo or other device from a submarine by pumping a working fluid, usually seawater, behind the device in the launch tube. The two most common launch devices are the ram pump and turbine pump ejection systems. Both systems are mechanically complex and tend to radiate noise into the surrounding fluid medium.

A ram pump launch apparatus converts potential energy from compressed air stored in a flask into working fluid kinetic energy. The ram pump system utilizes a massive piston apparatus to transfer sufficient working fluid, such as seawater, to launch a projectile. The mechanical friction and the mass of the piston act to reduce system efficiency and to produce substantial radiated noise. The ram pump system requires frequent maintenance because the system includes numerous mechanical components, in addition to the piston assembly.

A turbine pump launch apparatus also converts potential energy in the form of compressed air stored in a flask into kinetic energy of a working fluid. An air turbine drive unit is joined with a rotary impeller pump via a speed reduction unit. The turbine pump system is costly because of the complexity of the required mechanical components and is also noisy due to dynamic interaction of many of the system components.

In U.S. Pat. No. 4,848,210, issued Jul. 18, 1989 to Laurent C. Bissonnette, there is shown and described an elastomeric impulse energy storage and transfer system. The '210 system as shown is adapted to a torpedo launch system wherein an elastomeric bladder is distended by filling it with pressurized working fluid. When an impulse of energy is desired the elastomeric bladder discharges the working fluid to quietly eject a projectile from the launch system into the surrounding liquid. The elastomeric bladder used is generally spherical containing, when expanded, volume sufficient to fill the launch tube and the launchway forward of the launch tube.

Following expulsion of seawater from the elastomeric bladder, a low pressure region forms at the mouth of the launch tube because of the finite nature of the fluid volume available in the bladder and the competing momentum of the fluid exiting the launch tube. This low pressure region is undesirable because it causes excessive noise due to cavitation. To prevent the pressure differential and the noise associated therewith, additional seawater must be available to the launch tube after the elastomeric bladder has been discharged.

SUMMARY OF THE INVENTION

Accordingly, it is a general purpose and object of the present invention to provide a quiet, even flowing launch system for submarines.

A further object of the invention is to provide a weapon launch system which, after firing, does not create additional noise because of a low pressure region forming at the mouth of the launch tube.

Still another object is that the system be simple, reliable and low in cost.

With the above and other objects in view, as will hereinafter appear, a feature of the present invention is the provision of an apparatus for providing pressurized liquid to a launch tube for launching projectiles into a liquid medium. The device comprises an elastomeric bladder disposed inside a cylindrical bypass tube. The forward end of the bypass tube is open to the liquid medium, and the aft end of the tube is hydraulically connected to the launch tube. The elastomeric bladder is externally of generally cylindrical shape and has an open aft end, a closed forward end and a side wall of varying thickness. The open end of the bladder is hydraulically connected to a valve. The valve acts to control charging of the bladder and discharge of the bladder. The bladder expands to contact the wall of the bypass tube when the bladder is pumped full of pressurized seawater. On expanding, the thinnest portion of the bladder contacts the wall first. Ultimately the whole bladder will act to seal the bypass tube by contact with the bypass tube wall to prevent the external liquid medium from communicating with the launch tube through the bypass tube. Upon vehicle launch pressurized liquid is provided from the elastomeric bladder through the valve to the launch tube. The bladder returns to its original shape after discharge breaking contact with the bypass tube wall, and liquid is allowed to flow through the bypass tube into the launch tube to prevent cavitation from occurring at the launch tube breech.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of the invention may be employed in various and numerous embodiments without departing from the scope of the invention.

BRIEF DESCRIPTION OF THE DRAWINGS

A more complete understanding of the invention and many of the attendant advantages thereto will be readily appreciated as the invention becomes better understood by reference to the following detailed description when considered in conjunction with the accompanying drawings wherein.

DESCRIPTION OF THE PREFERRED EMBODIMENT

Figure 1:
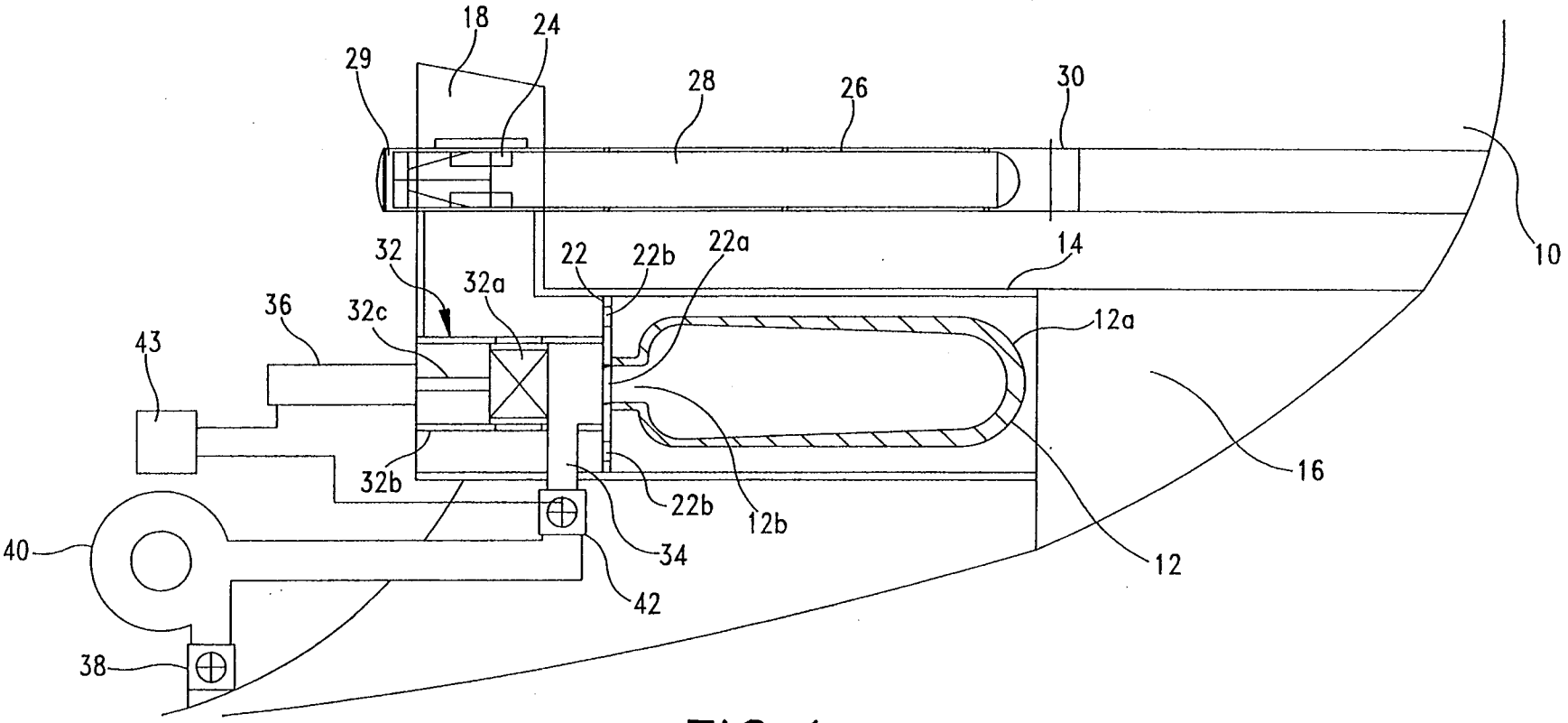
FIG. 1 is a diagrammatic view of the bow of a submarine cut away to display the launch device of the current invention as set for charging.

Referring now to FIG. 1 there is shown diagrammatic view of the bow of a submarine cut away to display the launch mechanism. The launch mechanism of the current invention is disposed within the hull of a submarine 10. Directions will be referred to in the ensuing drawings with references to forward being toward the bow of submarine 10 and references to aft being toward the rear of submarine 10; however, directions provided herein should not be construed to limit the invention to the specified orientation. The launch mechanism comprises an elastomeric bladder 12 mounted within a cylindrical bypass tube 14. Bladder 12 is made from Neoprene rubber, urethane, natural rubber or the like. Bypass tube 14 is a rigid cylinder with the forward end open to a free flood sea chest 16 and the aft end open to an impulse tank 18. Sea chest 16 is open to seawater at the same pressure as the outside of submarine 10. Elastomeric bladder 12 is mounted in bypass tube 14 by a spyder 22. Spyder 22 is a support structure having an inner flow aperture 22*a* surrounded by a plurality of outer flow apertures 22*b*. Spyder 22 suspends bladder 12 at the center of bypass tube 14 and allows hydraulic communication between bladder 12 and impulse tank 18 through inner flow aperture 22*a*. Flow between bypass tube 14 and impulse tank 18 occurs around the outside of bladder 12 through outer flow apertures 22*b*.

Impulse tank 18 is hydraulically connected to tube slots 24 in the walls of a launch tube 26 behind a device to be launched, such as a torpedo 28. Torpedo 28 is loaded in launch tube 26 through a breech valve 29. Impulse tank 18 provides a hydraulic impulse behind torpedo 28 to expel it from tube 26 via a muzzle valve 30.

Bladder 12 is substantially cylindrical having a closed forward end 12*a* positioned toward the open end of bypass tube 14 and an open aft end 12*b* positioned toward spyder 22. The wall of bladder 12 is not uniformly thick. Aft end 12*b* is thinner than the forward end 12*a*. Upon charging, thinner aft end 12*b* of bladder 12 will first expand to contact bypass tube 14. While bladder 12 is discharging, aft end 12*b* is the last part of bladder 12 to contact bypass tube 14. The material and thickness of bladder 12 are selected to provide the desired impulse profile. Open aft end 12*b* is in communication with a firing valve 32.

Firing valve 32 is positioned in hydraulic communication with elastomeric bladder 12, impulse tank 18, bypass tube 14, and a seawater inflow tube 34. Firing valve 32 is cylindrical with a movable piston 32*a* disposed within a valve cylinder 32*b*. Piston 32*a* is postionable by shipboard hydraulics 36 connected to a control rod 32*c*. To allow use of seawater to charge bladder 12, a charge sea valve 38 is provided in communication with a pump 40. Pump 40 is joined to a charge shut off valve 42 which is in communication with seawater inflow tube 34. Hydraulics 36, pump 40, and valves 38, 42 are actuated on command from control circuitry 43.

Figure 2A:
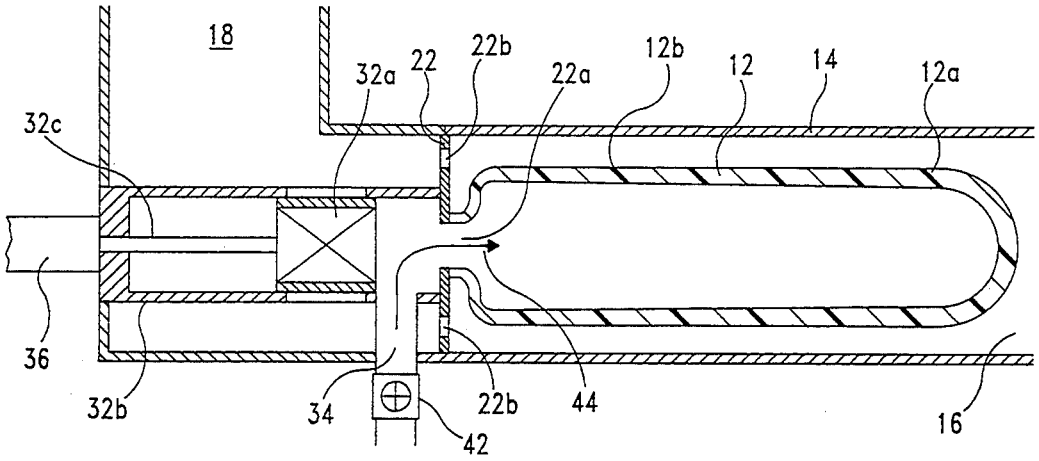
FIG. 2A is a detail view showing the fluid flow through the inventive device during charging.
Figure 2B:
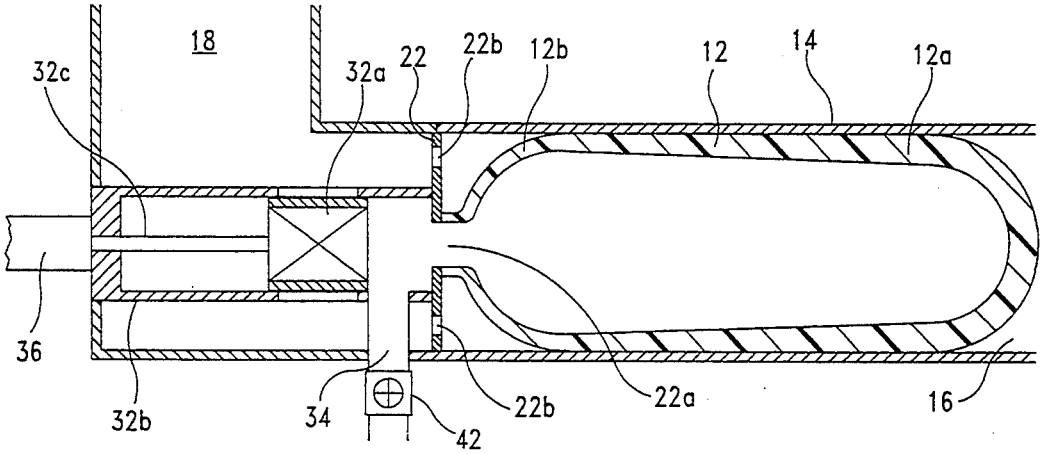
FIG. 2B is a detail view showing the configuration of the inventive device after charging.
Figure 2C:
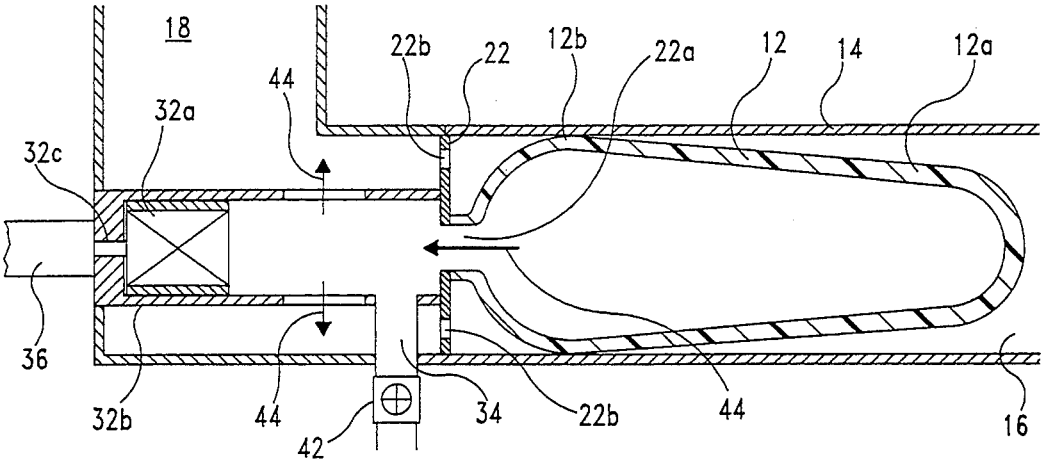
FIG. 2C is a detail view showing the fluid flow through the inventive device during launch.
Figure 2D:
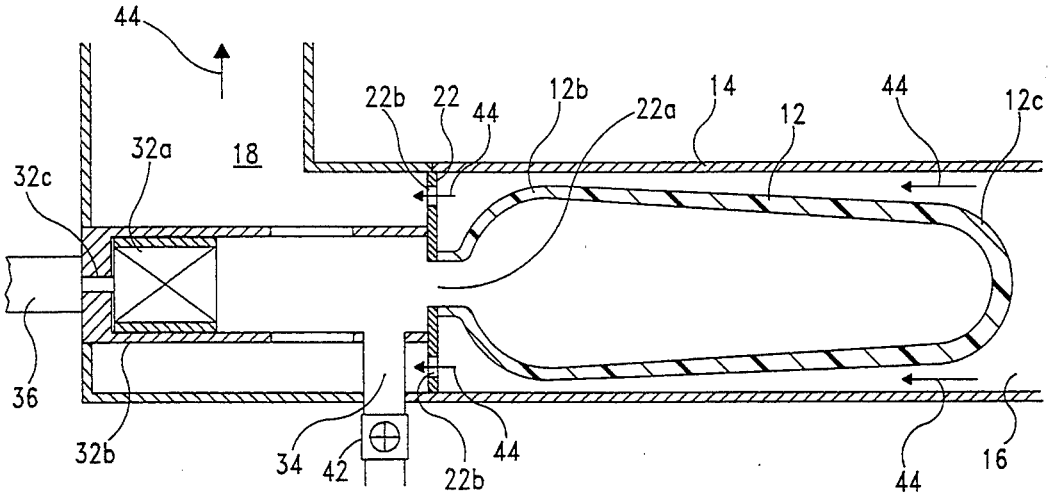
FIG. 2D is a detail view showing the fluid flow through the inventive device immediately after launch.

FIG. 2A, 2B, 2C and 2D show fluid flows through the elastomeric launch system during different stages of the launch process. In FIG. 2A, 2B, 2C and 2D, the flow of seawater is designated generally by flow arrows 44. Firing valve 32 has a charge position shown in FIG. 2A and 2B, and a firing position shown in FIG. 2C and 2D. FIG. 2A illustrates fluid flow with valve 32 in charge position. In FIG. 2B firing valve 32 remains in the charge position and shut off valve 42 is closed to seal pressure within elastomeric bladder 12. In FIG. 2C firing valve 32 is shown shifted to the firing position to allow hydraulic communication between elastomeric bladder 12 and impulse tank 18. Flow arrows 44 show the initial flow of seawater from elastomeric bladder 12 through valve cylinder 32b into impulse tank 18. FIG. 2D shows fluid flow around valve cylinder 32*b* after the initial impulse of the launch. Flow arrows 44 show fluid flow through spyder 22 and into impulse tank 18.

In FIG. 2A, there is shown the inventive device with valve 32 positioned to allow charging of bladder 12 from seawater inflow tube 34. In this position of valve 32, open aft end 12*b* of bladder 12 is sealed from communication with impulse tank 18. As shown in FIG. 1, charge sea valve 38 is opened to allow pump 40 to pump seawater through opened charge shut off valve 42 into elastomeric bladder 12 via inner flow aperture 22*a*. When the desired pressure is attained, charge shut off valve 42 and sea valve 38 are closed.

Referring now to FIG. 2B, there is shown the inventive device in its charged state. In this position of valve 32, aft end 12*b* of bladder 12 is completely sealed by valve 32 and shut off valve 42. Elastomeric bladder 12 is deformed radially to contact bypass tube 14. The contact between bladder 12 and the interior surface of bypass tube 14 seals tube 14 and prevents seawater from entering impulse tank 18 through outer flow apertures 22*b*, bypass tube 14, and sea chest 16.

Referring now to FIG. 1 and FIG. 2C, when torpedo 28 is ready for launch, firing valve 32 is shifted to firing position to allow pressurized seawater to flow from elastomeric bladder 12 through inner flow aperture 22*a* into impulse tank 18. Pressure in impulse tank 18 is transmitted to launch tube 18 to eject torpedo 28 therein. Thinner aft end 12*b* is the last portion of bladder 12 to contract thus preventing the seawater in impulse tank 18 from escaping through spyder 22 and bypass tube 14.

Referring now to FIG. 2D, as the seawater in elastomeric bladder 12 and impulse tank 18 is discharged, aft end 12*b* will contract away from bypass tube 14. At this stage, the pressure in impulse tank 18 will be less than the pressure in sea chest 16 and seawater will flow through bypass tube 14 around deflated elastomeric bladder 12 through spyder 22 outer flow apertures 22*b* and then to launch tube 26. Seawater flowing through impulse tank 18 avoids formation of a low pressure region at the mouth of launch tube 26 by providing a gradual reduction of seawater flow thereby filling the area behind launched torpedo 28. See FIG. 1.

The primary advantage of the present invention over elastomeric launchers such as the launcher shown in U.S. Pat. No. 4,848,210 is that the launcher of the present invention prevents cavitation at the breech of the launch tube after launching a device. Cavitation is prevented by providing a bypass cylinder which allows seawater to flow around the elastomeric bladder and into the launch tube after firing. During charging, the elastomeric bladder seals against the bypass tube and prevents transmission of seawater to the launch tube.

What has thus been described is an elastomeric launch system with seawater flow through a bypass tube allowing a device to be launched from a launch tube with reduced noise. Noise is reduced by providing fluid flow through the launch tube after the launch.

Obviously many modifications and variations of the present invention may become apparent in light of the above teachings. For example: any wall portion of the elastomeric bladder can be thinned to seal against the interior surface of the bypass tube; the impulse tank can be omitted by piping seawater directly to the launch tube from the apparatus; and a compact three way valve assembly can be used in place of the firing valve and shut off valve combination.

In light of the above, it is therefore understood that within the scope of the appended claims, the invention may be practiced otherwise than as specifically described.

What is claimed is:

1. An elastomeric launch system for providing pressurized fluid to a destination comprising:

a cylindrical bypass tube having a forward end, an aft end and a smooth inner surface, said forward end of said bypass tube being in communication with an ambient pressure liquid medium, and said aft end of said bypass tube being in hydraulic communication with said destination; and an elastomeric bladder fixed centrally within said bypass tube having a forward end, an aft end, and a wall portion, said forward end being sealed, said aft end having a mouth joined to communicate hydraulically with said destination, and said wall portion acting to seal said bypass tube forward end from said bypass tube aft end by contact between said wall portion and said bypass tube inner surface when said elastomeric bladder is filled with pressurized fluid.

2. The apparatus of claim 1 further comprising:

a firing valve in hydraulic communication between said elastomeric bladder and said destination, said valve being sealed to said mouth of said elastomeric bladder, and in hydraulic communication with and sealed to said destination, said firing valve positionable to allow charging of said elastomeric bladder and discharge of said elastomeric bladder to said destination; and a pump having an ambient pressure inlet in hydraulic communication with said liquid medium and a high pressure outlet in hydraulic communication with said firing valve.

3. The apparatus of claim 2 further comprising a shut off valve interposed between and in hydraulic communication with said pump and said firing valve for sealing said elastomeric bladder.

4. The apparatus of claim 3 further comprising an impulse tank interposed in hydraulic communication between said launch tube and said firing valve, said impulse tank interposed in hydraulic communication between said launch tube and said bypass tube.

5. The apparatus of claim 4 wherein said elastomeric bladder is made from a Neoprene rubber material.

6. The apparatus of claim 4 wherein said elastomeric bladder is made from a polyurethane rubber material.

7. The apparatus of claim 4 wherein said elastomeric bladder is made from a natural rubber material.

8. An apparatus for ejecting cylindrical projectiles into a liquid medium comprising:

at least one cylindrical launch tube, each said tube having a longitudinal axis, a muzzle end, a breech end, and a tube wall with an internal diameter greater than the diameter of said projectile, said wall having at least one aperture therein near the breech end of said tube, said tube provided for housing said projectile and slidably guiding said projectile during said ejection;

breech valve means, one each fixedly attached to said breech end of each said launch tube, for providing access to the interior volume of each said launch tube from said breech end for loading said projectiles;

muzzle valve means, one each fixedly attached to said muzzle end of each said launch tube, for providing egress for said projectiles from each said launch tube into said liquid medium;

a cylindrical bypass tube having a forward end, an aft end and a smooth inner surface, said forward end of said bypass tube being in communication with said liquid medium, and said aft end of said bypass tube being in hydraulic communication with said aperture in said launch tube;

a support means disposed within said bypass tube at said aft end of said bypass tube;

an elastomeric bladder fixed centrally within said bypass tube by said support means having a forward end, an aft end, and a wall portion, said forward end being sealed, said aft end being open, said wall portion having a variable thickness and said wall portion acting to seal said bypass tube forward end from said bypass tube aft end by contact between said wall portion and said bypass tube inner surface when said elastomeric bladder is filled with pressurized fluid;

a firing valve in hydraulic communication with said open aft end of said elastomeric bladder, said firing valve in hydraulic communication with said aperture in said launch tube, said firing valve positionable to allow charging of said elastomeric bladder and discharge of said elastomeric bladder to said aperture in said launch tube; and a pump having an ambient pressure inlet in hydraulic communication with said liquid medium and a high pressure outlet in hydraulic communication with said firing valve.

9. The apparatus of claim 8 further comprising an impulse tank interposed in hydraulic communication between said launch tube aperture and said firing valve, said impulse tank interposed in hydraulic communication between said launch tube aperture and said bypass tube.

10. The apparatus of claim 9 further comprising a shut off valve interposed between and in hydraulic communication with said pump and said firing valve for sealing said elastomeric bladder.

11. The apparatus of claim 10 wherein said elastomeric bladder is made from a Neoprene rubber material.

12. The apparatus of claim 10 wherein said elastomeric bladder is made from a polyurethane rubber material.

13. The apparatus of claim 10 wherein said elastomeric bladder is made from a natural rubber material.

* * * * *